10/15/85 4,547,219

United States Patent [19]

Matsuoka et al.

[11] Patent Number: 4,547,219

[45] Date of Patent: Oct. 15, 1985

[54] METHOD OF REDUCING IRON ORE USING PETROLEUM COKE

[75] Inventors: Toshio Matsuoka; Shinichi Kurozu, both of Niihama; Seiji Sugimori, Saijo, all of Japan

[73] Assignee: Sumitomo Heavy Industries, Ltd., Tokyo, Japan

[21] Appl. No.: 646,482

[22] Filed: Aug. 31, 1984

Related U.S. Application Data

[62] Division of Ser. No. 509,725, Jun. 30, 1983, abandoned.

[30] Foreign Application Priority Data

Jul. 2, 1982 [JP] Japan ..... 57-113860

[51] Int. Cl.[4] ..... C21B 13/00

[52] U.S. Cl. ..... 75/29

[58] Field of Search ..... 44/1 F; 75/33, 34, 37, 75/36, 40, 29, 42, 257

[56] References Cited

U.S. PATENT DOCUMENTS

| | | | |
|---|---|---|---|
| 393,553 | 11/1888 | Graff | 75/42 |
| 1,882,916 | 10/1932 | Riddle | 502/427 |
| 1,939,647 | 12/1933 | Arnold et al. | 585/640 |
| 3,329,626 | 7/1967 | Teter et al. | 502/427 |
| 3,642,657 | 2/1972 | Wennerberg et al. | 502/427 |
| 3,875,077 | 4/1975 | Sanga | 201/20 |
| 4,015,977 | 4/1977 | Crawford | 75/3 |
| 4,242,226 | 12/1980 | Siren | 502/427 |

FOREIGN PATENT DOCUMENTS

| | | | |
|---|---|---|---|
| 49-51301 | 5/1974 | Japan | 44/1 F |

*Primary Examiner*—Melvyn J. Andrews
*Attorney, Agent, or Firm*—Armstrong, Nikaido Marmelstein & Kubovcik

[57] ABSTRACT

A method for activating a petroleum coke which comprises impregnating the petroleum coke with an aqueous solution or suspension of an alkaline earth metal compound to contain 0.2% or more by weight of the alkaline earth metal compound in the coke.

3 Claims, 1 Drawing Figure

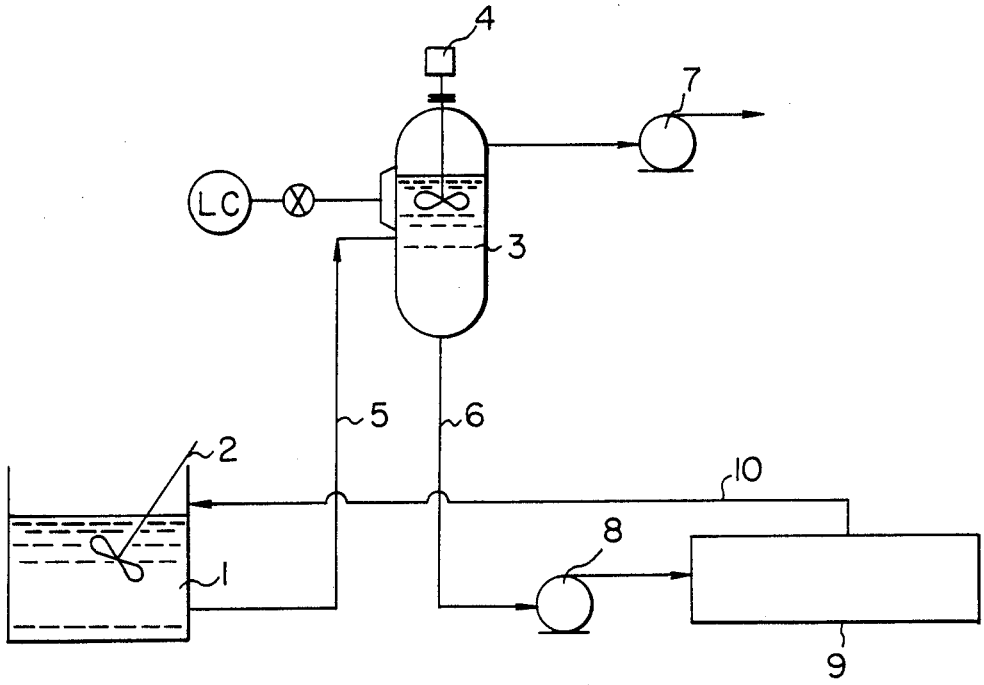
4
7
LC
3
5
6
2
10
8
1
9

METHOD OF REDUCING IRON ORE USING PETROLEUM COKE

This application is a division of application Ser. No. 509,725, filed June 30, 1983, now abandoned.

The present invention relates to a method for activating petroleum coke, more particularly, it relates to a method for activating petroleum coke used as a reducing agent in the direct reduction of iron ore.

The present inventors have invented a method for producing petroleum coke characterized in that asphalt and an alkaline earth metal compound are mixed and pyrolyzed to introduce the alkaline earth group into the resulting petroleum coke, and have already applied for a patent (Japanese Patent Application No. 198465/1981). The use of this method can improve the reactivity and sulfur-adsorbing property that petroleum coke possesses, and when this petroleum coke is used as a reducing agent in the direct reduction of iron ore, there are obtained great advantages in that high reactivity is obtained as compared with other solid reducing agents, and further, a great saving in sulfur scavenger (flux), so far externally added, can be achieved.

The present invention was made with the object of improving the reactivity, as in the foregoing invention of Japanese Patent Application No. 198465/1981, but not by adding alkaline earth metal compounds to asphalt as described above, but by treating petroleum coke produced by the conventionally employed method.

Next, as one example, an illustration will be given on a case wherein the present invention is used for a reducing agent in the direct reduction of iron ore.

Petroleum coke is used as a solid reducing agent in the direct reduction of iron ore for the reason that carbon monoxide gas produced by the so-called Boudouard reaction ($C+CO_2 \rightarrow 2CO$) is used as a reducing agent. The Boudouard reaction varies with the kind of carbon sources used, and the test result of reactivity according to the 7th section of JIS K-2151 (page 24) shows that petroleum coke is not superior to coal. However, petroleum coke does have an advantage over coal in that it contains little ash. It is therefore certain that petroleum coke can become a far more favorable reducing agent than coal if the above reactivity is simply improved.

In the present invention, the foregoing problem has been solved by impregnating produced petroleum coke with an alkaline earth metal compound.

As is well known, petroleum coke has inherent pores, and the reactivity of petroleum coke is markedly improved by impregnating with an alkaline earth metal compound deep into the pores. For promoting the impregnation, the above alkaline earth metal compound is used in solution in cheap solvents such as water, and a surface active agent is added if necessary. In this case, the use of anionic surface active agents such as the existing ABS (alkylbenzenesulfonic acid) is effective because petroleum coke is hydrophobic by nature.

Alkaline earth metal compounds include water-soluble compounds such as barium acetate, barium soap, magnesium acetate, etc. and compounds of low water-solubility such as calcium carbonate (lime stone), etc. For use of the latter, it is preferred to pulverize the latter into fine particles in advance and impregnate petroleum coke with a suspension of the fine particles, and it is also effective to use in combination therewith a stabilizer for the suspension.

For achieving a sufficient impregnation of aqueous solutions or suspensions containing alkaline earth metal compounds and if necessary, surface active agents and/or stabilizers for suspension into the pores of coke against the surface tension thereof, it is effective to hold the coke in a vacuum, and then take it out again into the atmosphere thereby impregnating the liquor into the coke.

Next, an example of the present invention will be illustrated with reference to the accompanying drawing.

In the drawing, 1 is a slurry tank filled with the slurry formed from petroleum coke, calcium carbonate the water (together with a surface active agent and/or stabilizer, if necessary). The slurry can be uniformly mixed by stirring by means of a stirrer 2. A vacuum tank 3 is set above the slurry tank 1 and connected with the tank 1 by a slurry-riser pipe 5. The slurry in the vacuum tank 3 is uniformly mixed by stirring by means of a stirrer 4. The length of the riser pipe is determined so that a difference in level between the surface of slurry in the vacuum tank 3 and that in the slurry tank 1 is about 10 m. In the drawing, 7 is a vacuum pump and 8 is a slurry pump. The level of the slurry surface in the vacuum tank 3 is regulated within a proper range by the action of an LC (liquid surface controller). A slurry pipe 6 connects the bottom of the vacuum tank 3 with a dehydrating apparatus 9 through a slurry pump 8.

Amounts of petroleum coke and pulverized calcium carbonate are so introduced into the slurry tank 1 that the calcium content of coke after impregnation is 0.5% or more. The slurry is then sent to the vacuum tank 3 through the slurry-riser pipe 5. During ascending through the riser pipe 5, the slurry is gradually fed to a vacuum whereby the pores of petroleum coke are deaerated and filled with the slurry containing calcium carbonate, and finally, the slurry containing air bubbles reaches the vacuum tank 3. In this tank 3, the level of the slurry surface is kept constant because, as described above, the length of the riser pipe 5 is set so as to keep a balance with the atmospheric pressure. Petroleum coke sufficiently impregnated with calcium carbonate is then withdrawn through the bottom of the vacuum tank 3, dehydrated by a dehydrating apparatus 9, and if necessary, further dried for the intended use. The residual liquor or slurry is returned to the slurry tank 1 through a pipe 10 and reused.

In the example above, a dehydrating apparatus is used, but the following method may be used in place of it: The void content of petroleum coke is previously measured, and a calcium carbonate-containing liquor of amounts below the void content is applied to the petroleum coke in a vacuum tank; by this, when atmospheric pressure is restored, all the liquor can be absorbed in the pores, leaving little water adhering to the surface, and thus, dehydration and/or drying procedure is not, for practical purposes, required.

In the example above, an illustration was given on treatment with calcium carbonate, but it is of course possible to carry out activation treatment with other alkaline earth metal compounds in the same manner as above or using aqueous solutions of the compounds.

As to the concentration of alkaline earth metal compounds, a sufficient activating effect is obtained, for example, with a calcium concentration of as small as about 0.2 wt.% based on the total weight of petroleum coke. The larger the impregnation amount is, the greater effect as a sulfur scavenger (flux) can be expected.

The results of tests on the reactivity of various cokes treated by the foregoing example are shown in Table 1.

TABLE 1

Reactivity of various cokes

| Alkaline earth metal compound used for impregnation | Concentration in coke (wt. %)* | Reactivity index (%)** |
|---|---|---|
| No impregnation | — | 43 |
| Calcium acetate | 0.19 Ca | 61 |
| Barium acetate | 3.5 Ba | 63 |
| Barium soap | 3.4 Ba | 65 |
| Calcium carbonate (lime stone) | 0.63 Ca | 58 |
| Magnesium acetate | 2.27 Mg | 50 |

*Converted to dry basis.

**A value, as expressed in insert equation × 100, of the outlet gas when the test was carried out at 1000° C. according to "Testing method for Reactivity of Coke" described in the 7th section of JIS K-2151 (page 24).

As is apparent from Table 1, petroleum coke impregnated with alkaline earth metal compounds shows a remarkably improved reactivity as compared with petroleum coke without impregnation.

As described above, the present invention not only improves the reactivity of petroleum coke, but also is advantageous in cost reduction because the present invention can be achieved with simple treatment apparatus.

What is claimed is:

1. In a method of reducing iron ore wherein the iron ore is directly reduced in the presence of a solid reducing agent, by carbon monoxide gas which is produced from the solid reducing agent in the presence of $CO_2$ by the reaction $C+CO_2 \rightarrow 2CO$, the improvement which comprises providing, as the source of the carbon monoxide gas a solid reducing agent, which is an activated petroleum coke produced by impregnating petroleum coke under reduced pressure with an aqueous solution or suspension of an alkaline earth metal compound to contain 0.2% or more by weight of the alkaline earth metal compound in the coke.

2. The method for reducing iron ore according to claim 1, wherein the aqueous solution or suspension of an alkaline earth metal compound contains an anionic surface active agent.

3. The method for reducing iron ore according to claim 1, wherein the alkaline earth metal compound is barium acetate, barium soap, magnesium acetate or calcium carbonate.

* * * * *